United States Patent [19]

Lindström

[11] Patent Number: 4,883,230

[45] Date of Patent: Nov. 28, 1989

[54] CABLE SWITCHING DEVICE

[75] Inventor: Lennart Lindström, Vällingby, Sweden

[73] Assignee: Kabmatik AB, Vällingby, Sweden

[21] Appl. No.: 203,112

[22] Filed: Jun. 7, 1988

[30] Foreign Application Priority Data

Jun. 12, 1987 [SE] Sweden ..... 8702454

[51] Int. Cl.[4] ..... B65H 54/00

[52] U.S. Cl. ..... 242/25 R; 242/25 A

[58] Field of Search ..... 242/82, 16, 17, 25 A, 242/25 R, 47.03, 78, 78.8, 18 A, 54 R

[56] References Cited

U.S. PATENT DOCUMENTS

| | | | |
|---|---|---|---|
| 3,994,058 | 11/1976 | Saski et al. | 29/428 X |
| 4,019,543 | 4/1977 | Sasaki et al. | 140/111 X |
| 4,552,314 | 11/1985 | Noguchi et al. | 242/25 R |
| 4,610,404 | 9/1986 | Maccaferri | 242/25 R |

FOREIGN PATENT DOCUMENTS

| | | | |
|---|---|---|---|
| 94361 | 11/1983 | European Pat. Off. | 242/78 |
| 93065 | 5/1985 | Japan | 242/78 |
| 97173 | 5/1985 | Japan | 242/78 |

*Primary Examiner*—Stuart S. Levy
*Assistant Examiner*—E. Dunlap
*Attorney, Agent, or Firm*—Shapiro and Shapiro

[57] ABSTRACT

A cable switching device to be used when switching from a first rotatable drum (3) to a second rotatable drum (4) for take-up of a cable (2) or the like. The cable switching device comprises a pivotable guide arm (13) supporting the cable (2) and adapted to be directed to the first (3) or, alternatively, the second (4) drum, or to a cutting device (20), a guide arm (13) comprising a nose portion (18) movable into and out of the drum (4 or 3), a clamping member (15, 16, 19) in the guide arm (13) for temporary clamping of the cable (2), the cutting device (20) being adapted to cut the cable at a given distance from the guide arm nose portion (18), and a catch arm (25) adapted to be inserted into the drum (4 or 3) through a suitable opening (23) in one of the drum sides (24) so as to take the cut-off free cable and (22) from the nose portion (18) inside the drum (4 or 3) and transfer it to a grapple (32) outside the drum (4 or 3), the grapple (32) being adapted to hold the cable end (22) and rotate together with the drum (4 or 3) during the subsequent winding of the cable (2) onto the drum.

10 Claims, 3 Drawing Sheets

CABLE SWITCHING DEVICE

BACKGROUND OF THE INVENTION

The present invention relates to a cable switching device to be used when switching from a first rotatable drum to a second rotatable drum for take-up of a cable or the like.

More precisely, the invention relates to a device for automatically attaching the end of a continuously produced cable to an empty drum for subsequent winding of the cable onto the drum, when a previous drum is full and must be replaced by an empty drum.

Drum switching is usually carried out in such a manner that, after the cable has been cut, the cable end is conducted manually to the empty drum and guided manually from the drum inside through a hole in the drum flange and then is attached to the outside of the drum flange. For electric cables, however, it should be possible to measure the electrical characteristics of the cable, for which reason it is inappropriate to attach the cable end to the circumference of the drum between the drum flanges. If the cable is rigid, it it also relatively easy to pass the cable end through the hole in the drum flange. The cables to which the present invention is specially applicable are relatively thin ($\phi$ 25 mm and less) and flexible, and therefore it is difficult to pass them through the hole in the flange.

One aspect of conventional drum switching is the need for manpower, which makes this technique susceptible to breakdown and comparatively expensive.

A further aspect of the manual method is the risk of bodily injury caused by the free ends of the cut cable.

SUMMARY OF THE INVENTION

The object of the present invention is to provide a device which facilitates switching from one take-up member to another for a continuously produced cable or the like, without necessitating any manual operation.

A further object of the invention is to provide a cable switching device which is rapid, reliable and comparatively uncomplicated and which thus can be manufactured at a moderate cost and provides for easy maintenance.

According to the invention, these objects are achieved in that the cable switching device comprises a pivotable guide arm supporting the cable and adapted to be directed to the first or, alternatively, the second drum, or to a cutting device, said guide arm comprising a nose portion movable into and out of said drum, a clamping member in the guide arm for temporary clamping of said cable, said cutting device being adapted to cut the cable at a given distance from the guide arm nose portion, and a catch arm adapted to be inserted into the drum through a suitable opening in one of the drum sides so as to take the cut-off free cable end from the nose portion inside the drum and transfer it to a grapple outside the drum, said grapple being adapted to hold the cable end and rotate together with the drum during the subsequent winding of the cable onto the drum.

Further developments of the invention are delineated hereinafter.

BRIEF DESCRIPTION OF THE DRAWINGS

A preferred embodiment of a device according to the present invention will now be described for the purpose of exemplification, reference being had to the accompanying drawings in which.

DETAILED DESCRIPTION OF THE INVENTION

Figure 1:
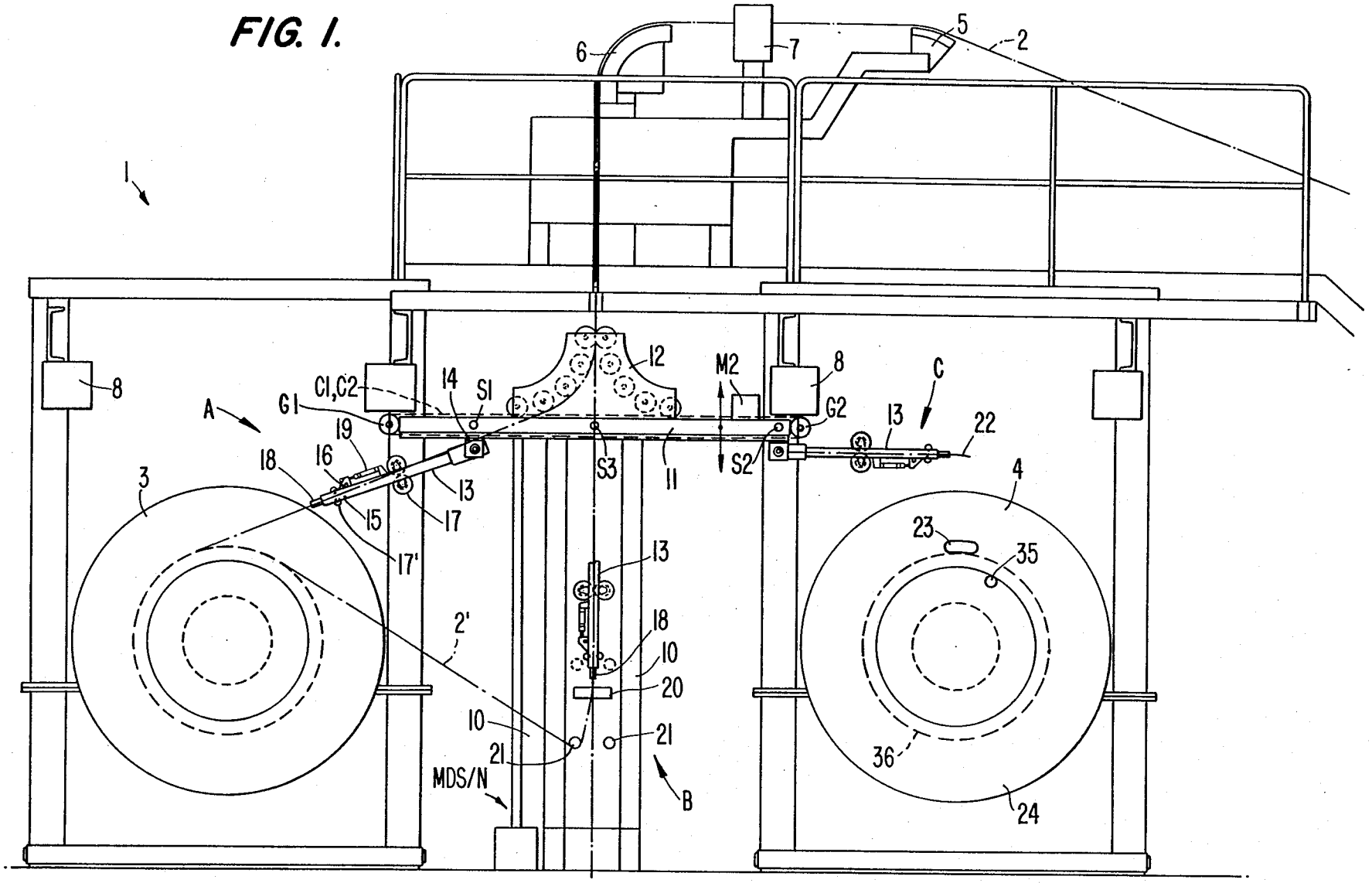
FIG. 1 is a schematic side view of a machine for winding a cable onto a rotating drum, in which the drum holder, the catch arm and carrier with grapple have been omitted for better clarity.

Reference is now made to FIG. 1 which illustrates a machine generally designated 1 for winding a cable 2 onto a rotating drum 3 or, alternatively, a rotating drum 4. In this case, the term "cable" denotes an electric, partly flexible cable, but the invention is also applicable to the winding of other, partly flexible, elongate bodies such as tubing, rope, wire, cord and the like. The machine in which the inventive cable switching device is incorporated, comprises a girder structure which supports guide means 5, 6 for the entering cable and an intermediate counter 7 measuring the cable length wound onto the drum 3 or 4. Further, the girder structure comprises two pairs of girders 8 of the type included in conventional overhead crane systems. Each overhead crane system supports two displaceble drum holders 9 each holding a drum 3, 4 and moving the drum in lateral direction on the girders 8 for winding the cable 2 onto the drum.

Between the overhead crain systems and below the cable entering point in the girder structure, two vertical guides 10 are mounted on which a lift frame 11 is vertically displaceable. A motor-driven screw means is rotatably mounted in parallel with and adjacent the guides and engages with a cooperating nut means in the lift frame. By operating the motor of the screw means, the lift frame 11 is displaced in vertical direction, and the position of the lift frame along the guides is adjusted by a number of sensors (not shown) connected to the motor. The motor-driven screw/nut arrangement is shown diagrammatically at MDS/N in FIG. 1.

On the lift frame 11 and below the cable entering point in the girder structure, there is arranged a pitch block 12 for guiding the cable in lateral direction to a guide arm 13 movably mounted on the lift frame. The guide arm 13 is supported by a carriage 14 running in grooves in the lift frame. By means of a motor M1 (shown diagrammatically in FIG. 2) mounted on the carriage, the guide arm can be set at different angles relative to the lift frame. The carriage 14 is moved on the lift frame by a motor-driven endless chain arrangement, which as indicated diagrammatically in FIG. 1, may comprise a pair of endless chains C1, C2 attached to the carriage and extending over two pairs of coaxial guide wheels G1, G2. The chains are driven by a motor M2, and by means of sensors (e.g. S1, S2, S3) mounted on the lift frame and connected to the motor, the position of the carriage on the lift frame is adjusted.

The cable discharged from the pitch block 12 runs to the active drum, in the illustrative case the drum 3, to be wound. The cable passes through the guide arm 13 which by means of the chain arrangement and the driving motor of the carriage is located in and aligned with the cable path, the A position. On its way through the guide arm, the cable passes between two rollers 17, two clamping jaws 15, 16 and two further rollers 17' in the guide arm and leaves the guide arm through the free end or nose portion 18 thereof. The clamping jaws 15, 16 form a clamping member for temporary clamping of the cable, the clamping jaw 15 being fixedly attaced to the guide arm, and the cooperating clamping jaw 16 being pivotably mounted in the guide arm and controlled by a pressure-fluid cylinder 19 on the guide arm. In FIG. 1, the open position of the clamping jaw 16 is indicated by full lines, and the closed or clamping position of the clamping jaw 16 by dashed lines.

A cutting device 20 and two pivotable stretching rollers 21 are attached to the guides 10. When the drum 3 is full, the pressure-fluid cylinder 19 is activated, and the clamping jaws clamp the cable, the drum is reversed to slacken the cable 2', and the carriage 14 is moved to a position vertically below the cable entering point in the girder structure, at the same time the guide arm being pivoted to be directed to said point and thus be oriented vertically, the B position. The resting position of the stretching rollers 21 which is shown by dashed circles, and the resting position of the cutting device 20 are spaced from the path of the cable 2'. The stretching rollers are pivoted on their arms by pressure-fluid cylinders in vertical arcuate paths, one stretching roller being brought into engagement with the cable. Then the stretching rollers 21 are pivoted towards each other by further arms operated by pressure-fluid cylinders, the cable as received being substantially aligned with the longitudinal axis of the guide arm 13. The cutting device 20, which is arranged at a given distance below the guide arm nose portion 18 when the guide arm has taken its defined B position, is moved horizontally to engage with the cable and is caused to cut the cable, whereby a cable end 22 of a given length projects from the nose portion 18.

The drum 3 is now released from the entering cable 2 and can be replaced by an empty drum for subsequent cable winding.

While the drum is being replaced, switching occurs to the empty drum 4 for cable take-up. Now the guide arm is moved to a horizontal position in which it projects from the lift frame 11, the C position, at the right end of the lift frame as shown in FIG. 1, and the lift frame is adjusted in vertical direction such that the guide arm nose portion 18 with the projecting cable end 22 is positioned close to a through hole 23 in one flange 24 of the drum adjacent the drum circumference 36, i.e. between the flanges of the drum.

Figure 2:
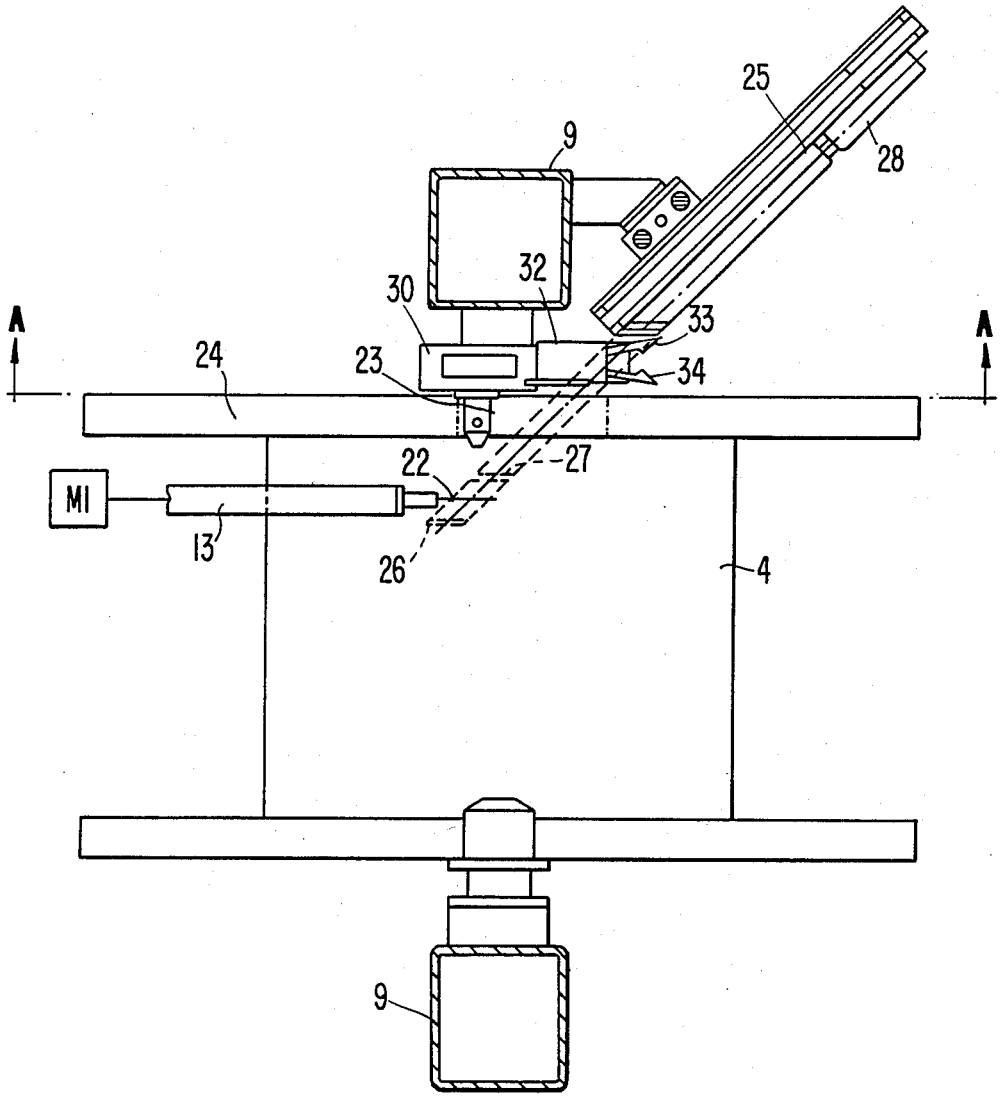
FIG. 2 is a schematic plan view of an empty drum which is supported by a pair of drum holders and through one flange of which one end of the catch arm extends into the drum to take the cable end from the guide arm.

Reference is now made to FIG. 2 which is a schematic plan view of the empty drum 4, the guide arm 13 in the C position and a catch arm 25 partly inserted through the hole 23 in the flange 24 of the drum. The catch arm 25 is indicated by dashed lines in its inserted position, and by full lines in its retracted position. The drum 4 is supported by the drum holders 9. The catch arm 25 has been inserted into the drum, before the guide arm nose portion 18 is moved into a position adjacent the catch arm end extending through the hole 23. The cable end 22 is inserted between the clamping jaws 26, 27 of the catch arm. The clamping jaws 26, 27 form a clamping member for temporary clamping of the cable end, the clamping jaw 26 being fixedly mounted on the catch arm outer end, and the cooperating clamping jaw 27 being displaceably mounted in the catch arm in the longitudinal direction thereof and controlled by a pressure-fluid cylinder 28 mounted on the catch arm.

The pressure-fluid cylinder 28 is activated, whereby the clamping jaws 26, 27 clamp the cable end 22 which is then released by the clamping jaws 15, 16 of the guide arm, whereupon the guide arm 13 is caused to take its position for winding the cable, i.e. a position corresponding to the A position but relative to roller 4. The catch arm with the cable end is pulled out through the hole 23 in the flange 24.

Figure 3:
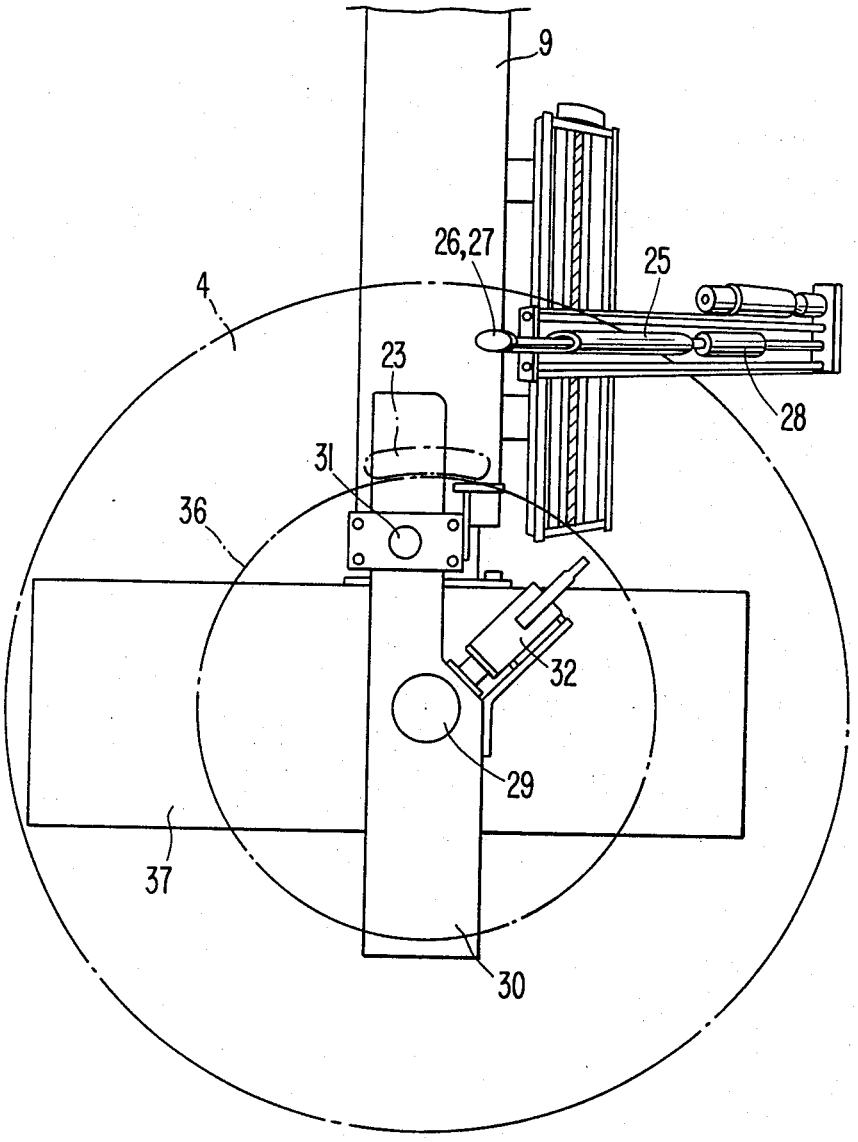
FIG. 3 is a schematic view, partly in section, taken along line A—A in FIG. 2 of the drum holder and showing the catch arm and the carrier arm with the grapple.

Reference is now made to FIG. 3 which illustrates that the catch arm is displaceably arranged in its longitudinal direction and in a vertical plane on one of the drum holders 9. The catch arm 25 is supported by two cooperating sliding means operated by pressure-fluid cylinders, and the movements of the catch arm are controlled by sensors connected to the pressure-fluid cylinders. FIG. 3 shows the catch arm in its inactive or initial position.

After the catch arm 25 has been disengaged from the drum flange 24, the drum 4 is rotated through a given angle in a counterclockwise direction in FIG. 3, and the catch arm is lowered onto the drum holder 9. The drum is supported by a journal 29 which is rotatably mounted in the drum holder and driven by a motor and its associated gear 37. There is fixedly attached to the journal 29 a carrier arm 30 supporting a carrier pin 31 which is adjustable in the longitudinal direction of the carrier arm, and a grapple 32 arranged at an angle of about 45° relative to the longitudinal direction of the carrier arm. The carrier pin 31 cooperates with a corresponding hole 35 (FIG. 1) in the flange 24 of the drum for rotation thereof.

When the catch arm 25 has been lowered to a given position, and the grapple 32 is vertically oriented, the cable 2 is positioned between the jaws 33, 34 of the grapple. These jaws 33, 34 are pivotably mounted in the grapple casing and moved by a pressure-fluid cylinder between an open and a closed or clamping position. When the cable has been inserted between the grapple jaws, these jaws and the jaws 26, 27 of the catch arm are opened to release the cable end 22, whereupon the catch arm 25 returns to its initial position on the drum holder. Subsequently, the drum is rotated in a clockwise direction in FIG. 3, and the grapple 32 clamps the cable end during winding of the cable onto the drum, whereupon the jaws 33, 34 are opened.

In the cable switching device according to the present invention, the cable is preferably wound in the following manner.

The cable 2 runs through the guide means 5, 6, the counter 7 and the guide arm 13 to the drum 3. After winding of a given cable length, the rotating drum is braked step-by-step to a stop, whereupon the clamping members 15, 16, 19 of the guide arm are caused to clamp the cable. The drum is rotated in the opposite direction through about ½ revolution, and the guide arm is moved from the A position to the B position. Then the stretching rollers 21 seize the cable loop 2' and orient the cable vertically below the catch arm. The cutting device 20 cuts the cable in such manner that a cable end 22 of a given length projects from the nose portion 18. The guide arm 13 positions the cable end adjacent the hole 23 in the flange 24 of the drum 4, where the catch arm receives the cable end and pulls it through the hole 23 to the outside of the drum. The catch arm 25 then delivers the cable end to the grapple 32 on the carrier arm 30 (before that, the drum has been rotated such that the grapple is vertically oriented). Finally, the drum is rotated in the opposite direction, while the grapple 32 retains the cable end 22 during winding of the cable onto the drum 4, whereupon the winding procedure is repeated with the opposite drum 3 to which means corresponding to the means 26–34 are connected.

The invention is, of course, not restricted to the embodiment shown, but can be modified within the scope of the appended claims. Thus, the guide arm can be pivotably mounted in a point which is fixed in space and can optionally be of a telescoping design. Furthermore, it would be possible to use only one drum station, which however would mean a certain waste of time for switching the drums. It is also conceivable to use drums of different size and capacity.

I claim:

1. In a system for winding a partly flexible elongate body (2), such as a cable, selectively on one of a first rotatable take-up drum (3) and a second rotatable take-up drum (4), a switching device for switching the elongate body from one of said drums to the other for take-up, said switching device comprising a pivotable guide arm (13) for supporting the elongate body (2) and adapted to be directed to the first (3) or, alternatively, the second (4) drum, as selected, or to a cutting device (20), said guide arm (13) comprising a nose portion (18) movable into and out of the selected drum (4 or 3), a clamping member (15, 16, 19) in the guide arm (13) for temporary clamping of said elongate body (2), said cutting device (20) being adapted to cut the elongate body at a given distance from the guide arm nose portion (18), and a catch arm (25) adapted to be inserted into the selected drum (4 or 3) through a suitable opening (23) in one of the sides (24) of the selected drum so as to take the cut-off free end (22) of the elongate body from the nose portion (18) inside the selected drum (4 or 3), and transfer it to a grapple (32) outside the selected drum (4 or 3), said grapple (32) being adapted to hold the free end (22) and rotate together with the selected drum (4 or 3) during the subsequent winding of the elongate body (2) onto the selected drum.

2. A device as claimed in claim 1, characterized in that said guide arm (13) is supported by a carriage (14) and is pivotable by an operating means on said carriage, that said carriage (14) is displaceably arranged on and along a lift frame (11), and that said lift frame (11) is vertically displaceable.

3. A device as claimed in claim 2, characterized in that said carriage (14) is movable on said lift frame (11) by a motor-driven endless chain arrangement, including sensors connected to the motor and arranged for adjusting the position of said carriage on the lift frame.

4. A device as claimed in claim 2, characterized in that said lift frame (11) is displaceably mounted on two vertically oriented guides (10) and is operable by means of a sensor-controlled motor-driven screw/nut arrangement for adjusting the position of said lift frame in vertical direction.

5. A device as claimed in claim 2, characterized in that said cutting device (20) is arranged substantially directly below said lift frame (11), that said cutting device (20) is displaceable transversely of the direction of movement of said lift frame, and that two stretching rollers (21) are adapted to seize the elongate body and position the same for cutting by said cutting device (20).

6. A device as claimed in claim 1 characterized in that said guide arm (13) supports said clamping member (15, 16, 19) at its nose portion (18), and that said clamping member (15, 16, 19) comprises a fixedly mounted clamping jaw (15) and a pivotable clamping jaw (16) which is operable by means of a pressure-fluid cylinder (19).

7. A device as claimed in claim 1, characterized in that the selected drum (4 or 3) for take-up of the elongate body (2) is supported by a drum holder (9) and is rotatable by means of a carrier arm (30) drivably mounted on said drum holder (9), that said catch arm (25) is displaceably mounted on said drum holder in a plane which is parallel to the longitudinal axis of said drum holder, and that a clamping member (26–29) for the elongate body free end (22) is arranged at the catch arm end which is adapted to conducted through said one side (24) of the selected drum (4 or 3).

8. A device as claimed in claim 7, characterized in that said clamping (26–29) comprises a fixedly mounted clamping jaw (26) and a clamping jaw (27) which is mounted in the catch arm (25) to be displaceable in the longitudinal direction thereof and which is operable by means of a pressure-fluid cylinder (28) arranged on said catch arm.

9. A device as claimed in claim 7, characterized in that said catch arm (25) is mounted to be displaceable in its longitudinal direction through said one side (24) of the selected drum (4 or 3) to a position adjacent the nose portion (18) of said guide arm (13) inside the selected drum (4 or 3).

10. A device as claimed in claim 7, characterized in that said grapple (32) is mounted on said carrier arm (30) at an angle of about 45° relative to the longitudinal direction of the carrier arm axis, and that said grapple comprises a pair of pivotable jaws (33, 34) operated by fluid pressure and adapted to hold the elongate body free end (22) during winding of said elongate body (2) onto the selected drum (4 or 3).

* * * * *